US009012758B2

(12) United States Patent
El-Khadem et al.

(10) Patent No.: US 9,012,758 B2
(45) Date of Patent: Apr. 21, 2015

(54) ACOUSTICAL TRANSMISSION LINE CHAMBER FOR STRINGED MUSICAL INSTRUMENT

(71) Applicants: Joseph Rasheed El-Khadem, Redondo Beach, CA (US); Carla Wagner, Redondo Beach, CA (US)

(72) Inventors: Joseph Rasheed El-Khadem, Redondo Beach, CA (US); Carla Wagner, Redondo Beach, CA (US)

( * ) Notice: Subject to any disclaimer, the term of this patent is extended or adjusted under 35 U.S.C. 154(b) by 0 days.

(21) Appl. No.: 13/938,585

(22) Filed: Jul. 10, 2013

(65) Prior Publication Data

US 2014/0013929 A1 Jan. 16, 2014

Related U.S. Application Data

(60) Provisional application No. 61/670,089, filed on Jul. 10, 2012.

(51) Int. Cl.
*G10H 3/18* (2006.01)
*G10H 1/32* (2006.01)

(52) U.S. Cl.
CPC ... *G10H 3/18* (2013.01); *G10H 1/32* (2013.01)

(58) Field of Classification Search
USPC ..... 84/743, 723, 735
See application file for complete search history.

(56) References Cited

U.S. PATENT DOCUMENTS

| | | | | | |
|---|---|---|---|---|---|
| 2,001,723 | A | * | 5/1935 | Hammond, Jr. | 84/723 |
| 2,288,463 | A | * | 6/1942 | Kislingbury | 84/723 |
| 3,194,870 | A | * | 7/1965 | Tondreau et al. | 84/726 |
| 3,357,291 | A | * | 12/1967 | Carmichael | 84/267 |
| 3,612,741 | A | * | 10/1971 | Marshall | 84/723 |
| 3,696,700 | A | * | 10/1972 | Berardi | 84/291 |
| 3,730,046 | A | * | 5/1973 | Spence | 84/723 |
| 3,771,408 | A | * | 11/1973 | Wright | 84/291 |
| 3,781,451 | A | * | 12/1973 | Nolan | 84/723 |
| 3,878,748 | A | * | 4/1975 | Spence | 84/723 |
| 4,235,141 | A | * | 11/1980 | Eventoff | 84/672 |
| 4,241,637 | A | * | 12/1980 | Brent | 84/743 |
| 4,245,540 | A | * | 1/1981 | Groupp | 84/726 |
| 4,312,258 | A | * | 1/1982 | Park | 84/743 |
| 4,351,217 | A | * | 9/1982 | Wechter | 84/743 |
| 4,464,967 | A | * | 8/1984 | Trimborn | 84/743 |
| 5,056,400 | A | * | 10/1991 | Wachi et al. | 84/600 |
| D410,670 | S | * | 6/1999 | Medley | D17/20 |
| 6,320,113 | B1 | * | 11/2001 | Griffin et al. | 84/738 |
| 6,800,797 | B2 | | 10/2004 | Steiger, III | |
| 7,671,268 | B2 | * | 3/2010 | Nicoll | 84/718 |
| 8,193,438 | B2 | * | 6/2012 | Hoshino | 84/644 |
| 8,193,768 | B2 | * | 6/2012 | Hallett | 320/108 |
| 8,389,835 | B2 | * | 3/2013 | Findley et al. | 84/267 |
| 8,542,848 | B1 | * | 9/2013 | Krutsick | 381/118 |
| 2007/0180975 | A1 | | 8/2007 | Paris et al. | |
| 2014/0013929 | A1 | * | 1/2014 | El-Khadem et al. | 84/726 |

FOREIGN PATENT DOCUMENTS

| | | |
|---|---|---|
| CA | 2372014 | 2/2002 |
| JP | 2007-333757 | 12/2007 |

* cited by examiner

*Primary Examiner* — David S. Warren
(74) *Attorney, Agent, or Firm* — Welsh Flaxman & Gitler LLC

(57) ABSTRACT

An electric stringed musical instrument includes a body, a neck extending from the body, a plurality of tensioned strings extending between the body and the neck and an electric pick-up mounted to the body at a location for cooperation with the tensioned strings. The electric stringed musical instrument also includes an amplifier electrically connected to the electric pick-up and a speaker connected to the amplifier for the generation of sound waves. An elongated acoustic chamber extends from the speaker to an output port. The amplifier, speaker and elongated acoustic chamber are housed within the body.

8 Claims, 5 Drawing Sheets

ACOUSTICAL TRANSMISSION LINE CHAMBER FOR STRINGED MUSICAL INSTRUMENT

CROSS REFERENCE TO RELATED APPLICATION

This application claims the benefit of U.S. Provisional Application Ser. No. 61/670,089, entitled "ACOUSTICAL TRANSMISSION LINE CHAMBER FOR STRINGED MUSICAL INSTRUMENT," filed Jul. 10, 2012.

BACKGROUND OF THE INVENTION

1. Field of the Invention

The invention relates to stringed instruments such as electrical guitars. More particularly, the invention relates to stringed instrument with an integrated power amplifier, a speaker and elongated acoustic chamber housed within the body of the instrument.

2. Description of the Related Art

Electric guitars with a built-in amplifier/speaker combination all suffer from the same problem: poor sound quality. The reason for this is that the speaker "cabinet" is the guitar's body and the available space for air resonance is severely limited when compared to a typical external amplifier/speaker box. This limited space yields inferior sound quality, especially in the mid and low frequency ranges. The assumption has been that this issue cannot be overcome in a satisfactory manner and so the prior art has been limited to practice/travel instruments, toys and novelty instruments.

The present invention solves this problem and allows for an electric guitar or other stringed instrument with a built-in amplifier and speaker to produce a rich, full-bodied, pleasing tone, suitable for live performance or recording.

SUMMARY OF THE INVENTION

It is, therefore, an object of the present invention to provide an electric stringed musical instrument including a body, a neck extending from the body, a plurality of tensioned strings extending between the body and the neck and an electric pick-up mounted to the body at a location for cooperation with the tensioned strings. The electric stringed musical instrument also includes an amplifier electrically connected to the electric pick-up and a speaker connected to the amplifier for the generation of sound waves. An elongated acoustic chamber extends from the speaker to an output port. The amplifier, speaker and elongated acoustic chamber are housed within the body.

It is also an object of the present invention to provide an electric stringed musical instrument wherein the amplifier includes a battery.

It is another object of the present invention to provide an electric stringed musical instrument wherein the battery is a rechargeable battery.

It is a further object of the present invention to provide an electric stringed musical instrument wherein the elongated acoustic chamber is an acoustic transmission line.

It is also an object of the present invention to provide an electric stringed musical instrument wherein the electric stringed musical instrument is a guitar.

It is a further object of the present invention to provide an electric stringed musical instrument wherein the speaker is housed within an enclosure so as to define a speaker acoustic cabinet.

It is another object of the present invention to provide an electric stringed musical instrument wherein the elongated acoustic chamber is connected to the speaker acoustic cabinet.

It is also an object of the present invention to provide an electric stringed musical instrument including acoustic damping material to control feedback.

It is another object of the present invention to provide an electric stringed musical instrument wherein the body includes a front surface and the speaker is mounted on the front surface in alignment with a speaker aperture formed in the front surface.

It is also an object of the present invention to provide an electric stringed musical instrument including a body, a neck extending from the body, a plurality of tensioned strings extending between the body and the neck and an electric pick-up mounted to the body at a location for cooperation with the tensioned strings. The electric stringed musical instrument also includes an amplifier electrically connected to the electric pick-up, and a rechargeable battery powering the amplifier. A speaker is connected to the amplifier for the generation of sound waves. The amplifier and speaker are housed within the body.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
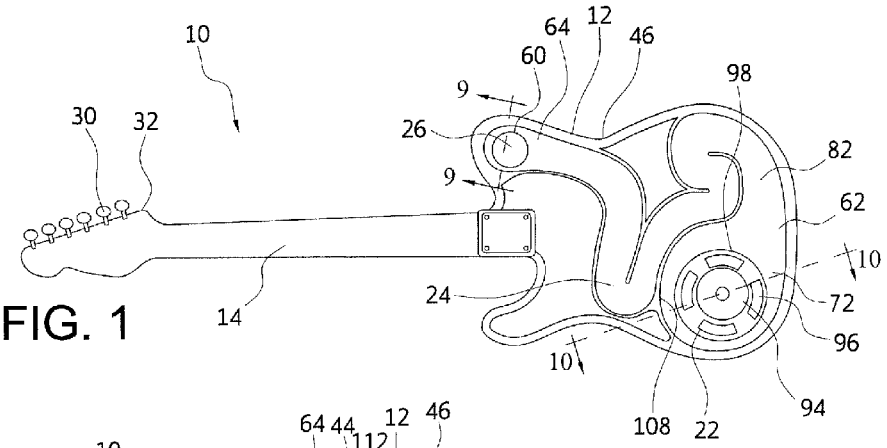
FIG. 1 is a back side view, with the back cover member thereof removed, of an electric guitar in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

With reference to FIGS. 1 to 10, an electric stringed musical instrument 10 in accordance with the present invention is disclosed. The electric stringed musical instrument is preferably an electric guitar 10, and the term guitar will be used throughout the present description although it is appreciated the concepts underlying the present invention may be applied to other electric stringed musical instruments.

The electric guitar 10 includes a body 12 and a neck 14 extending from the body 12. A plurality of tensioned strings 16 extends between the body 12 and the neck 14. An electric pick-up 18 is mounted to the body 12 at a location for cooperation with the tensioned strings 16 and an amplifier 20 is electrically connected to the electric pick-up 18. An acoustic driver or speaker 22 is connected to the amplifier 20 for the generation of sound waves and an elongated acoustic chamber 24 extends from the speaker 22 to an output port 26 for external transmission of the sound generated by the speaker 22. The amplifier 20, speaker 22 and elongated acoustic chamber 24 are housed within the body 12.

As will be appreciated based upon the following disclosure, the present electric stringed musical instrument 10 employs an elongated acoustic chamber 24 known in Hi-Fi audio speaker design as a "Transmission Line" or "Labyrinth." As will be appreciated based upon the following disclosure, the elongated acoustic chamber 24 is integrated within the electric stringed musical instrument 10, such as a guitar, in various way, for example, by machine routing in a solid body from which the body of the electric guitar is formed, use of an insert which creates the desired elongated acoustic chamber in a hollow body, or possibly a mold or casting in the case of a plastic, fiberglass, or Lucite/Plexiglas stringed musical instrument.

The implementation of the carefully tuned acoustic transmission line in the form of the elongated acoustic chamber 24 allows the full low and low-mid frequency sound waves to develop in a much smaller space than an open cavity that lacks a acoustic transmission line. With this in mind, the elongated acoustic chamber 24 is shaped to reinforce the low frequency sound waves. The low frequency sound waves are reinforced by the increased length they travel through the tuned labyrinth defined by the elongated acoustic chamber. As such, the elongated acoustic chamber in accordance with the present invention may be thought of as being of a serpentine configuration with an extended, generally convoluted length. Such structure has never before been applied to an electric stringed musical instrument. The net result is a balanced, full frequency amplified sound without use of an external amp or speaker. In addition to improving the acoustic characteristics of the sound generated by the electric stringed musical instrument 10, the resonant nature of the cabinet or body 12 of the instrument 10 and the integrated speaker 22 also gives the player a unique visceral sensation from the intensified vibration of the back of the instrument 10 against the player's body.

For example, and for an average/standard size electric guitar, 2 inches in width, with a 4 inch diameter speaker, a labyrinth elongated acoustic chamber of approximately 32 inches in length with a cross-sectional diameter of approximately 1.75 inches (in the case of an elongated acoustic chamber having a round cross section when viewed along the longitudinal axis thereof) will substantially reinforce the fundamental vibration frequency of the low "E" (6th) string on an electric guitar in standard tuning (EADGBE) and also reinforce low frequency (bass) harmonics across the guitar's entire range. In addition, it is appreciated a uniform taper (decreasing is cross sectional width as it extends from the first end of the elongated acoustic chamber to the second end of the elongated acoustic chamber) along the entire length of the elongated acoustic chamber to the output port helps eliminate unwanted resonance for a balanced sound. Such a taper is considered helpful but not required. A representative embodiment is shown with dimensions in FIG. 8.

The serpentine nature of the elongated acoustic chamber also functions to isolate the sound waves from the guitar's pickup(s) to prevent acoustic coupling (feedback). As such, the addition of the serpentine elongated acoustic chamber allows for the successful combination of the speaker "cabinet" and guitar by controlling unwanted feedback—the sympathetic vibration of the guitar's strings with the loudspeaker's vibration. It is, however, appreciated that a certain amount of controllable feedback is desirable to achieve the feel of playing through a large amplifier/speaker box.

As discussed above, an embodiment in accordance with a preferred embodiment is composed of an electric guitar 10 with an integrated power amplifier 20 (with an on/off switch 21), a speaker 22, a speaker (tone) cabinet or acoustic chamber 72, and an elongated acoustic chamber 24 transmitting sound from the speaker acoustic cabinet 72 to the output port 26. In accordance with a preferred embodiment, and in order to enhance the portability of the present guitar 10, the power amplifier 20 is battery 56 (preferably a rechargeable battery) powered and no power lines are therefore necessary. In addition to powering the power amplifier, the battery also powers all of the onboard electronics, that is, the amplifier, active tone circuits, "effects", etc. It is, however, appreciated an external power supply connected to the electric guitar, for example, a standard AC outlet or an external battery power supply, may be used for powering electronics of the guitar. It is appreciated another embodiment may include standalone amplifier/speaker combination and other embodiments with unique features.

As discussed above, the electric guitar 10 includes various features common to traditional electric guitars. The electric guitar 10 includes a body 12 from which projects a neck 14 provided with the usual peg head 30. A plurality of strings 16 are tensioned from the peg head 30 at the free end 32 of the neck 14 over a fret board 34 on the neck 14 to a bridge 36 mounted on the front surface 38 of the guitar body 12.

Mounted along the front surface 38 of the body 12 are the electric pick-ups 18 for sensing vibrations of the strings 16 when the guitar 10 is being used. Also mounted on the front surface 38 of the guitar 10 are various controls commonly employed in conjunction with electric guitars. For example, knobs 40 are provided for volume, tone and bass control. These knobs 40 are in communication with the amplifier 20 for controlling the output thereof when the guitar 10 is in use. It is appreciated the knobs on the front of the guitar may or may not have a traditional function. For example, traditional functions include "volume" controls for the pickups (transducers) and one or more controls for the "tone" (usually a cut or boost frequency attenuator in a "bass" or "treble" range). The knobs on present guitar may serve these functions or could control other preamp/amplifier functions such as "gain/overdrive", master volume, etc. As such, and while these particular control arrangements have been indicated it will be appreciated that these may be varied as desired.

Considering now the body 12 of the guitar 10, it includes a front surface 38 and a back surface 42 with side walls 44 extending therebetween. In accordance with a preferred embodiment, the body 12 is composed of a primary body member 46 and a back cover member 48. As such, the primary body member 46 forms the substance of the body 12, while the back cover member 48 is used to cover the back side 50 of the primary body member 46. While preferred embodiments are disclosed which rely upon a primary body member and a back cover member, it is appreciated the body may be construct in two relatively equivalent body parts. In accordance with such an embodiment a partial labyrinth elongated acoustic chamber is formed in each half (or some other fraction) of the body and then the two pieces are joined, glued, screwed, bolted together, etc to form the complete body. In accordance with such an embodiment there would not be a large removable back panel but smaller access panels for servicing the electronics, speaker access, etc.

Figure 7:
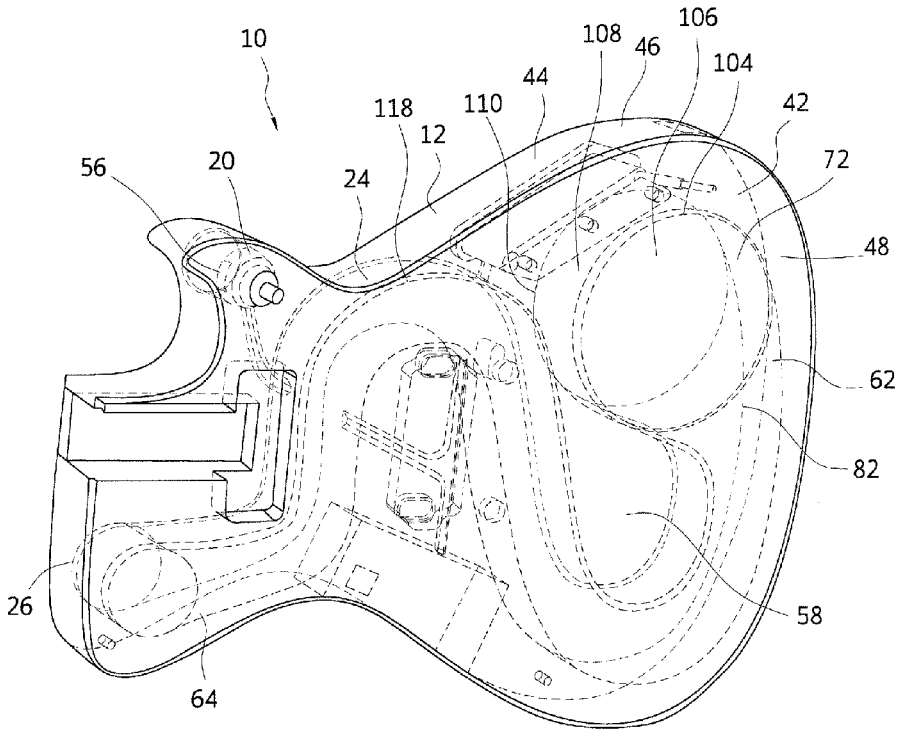
FIG. 7 is a front view of the electric guitar shown in FIG. 1 with various components shown in phantom lines.
Figure 8:
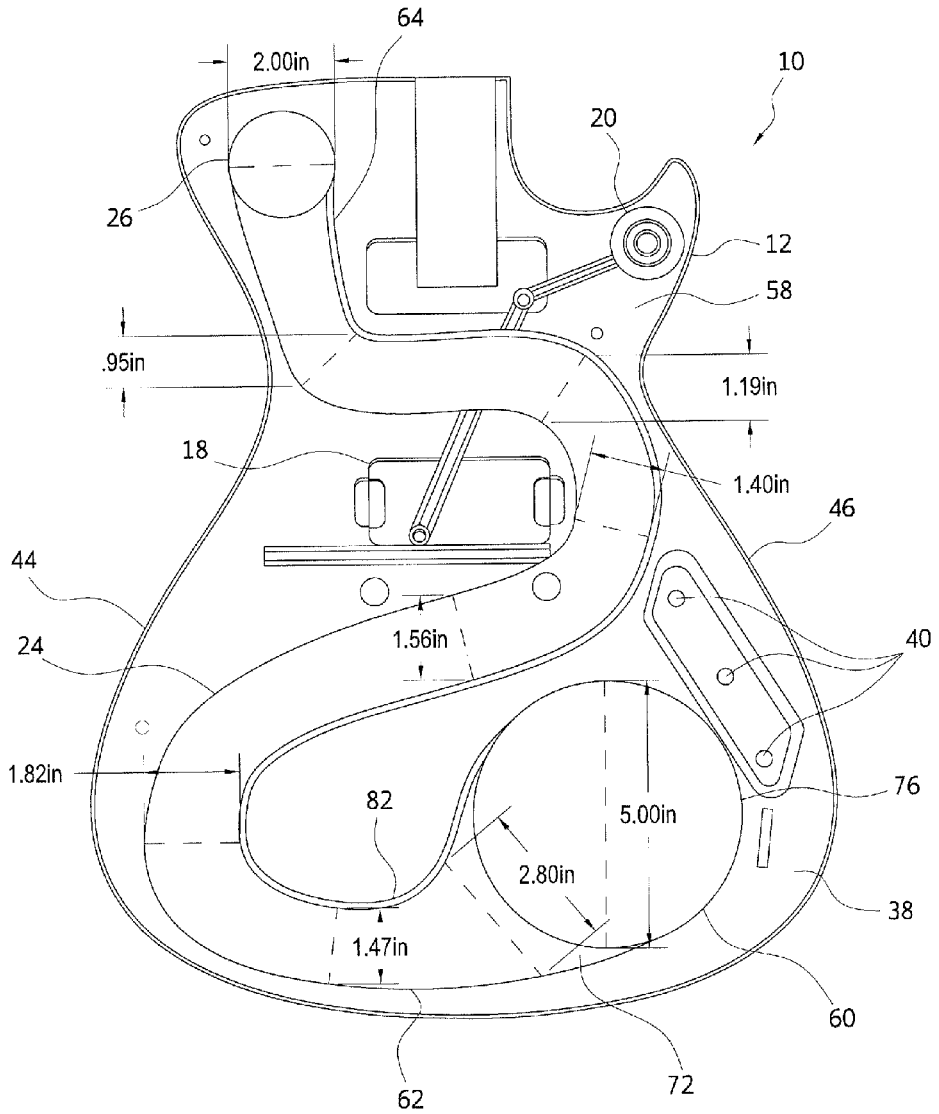
FIG. 8 is a front view of a guitar body in accordance with the present invention showing exemplary dimensions for the elongated acoustic chamber and the associated elements.
Figure 9:
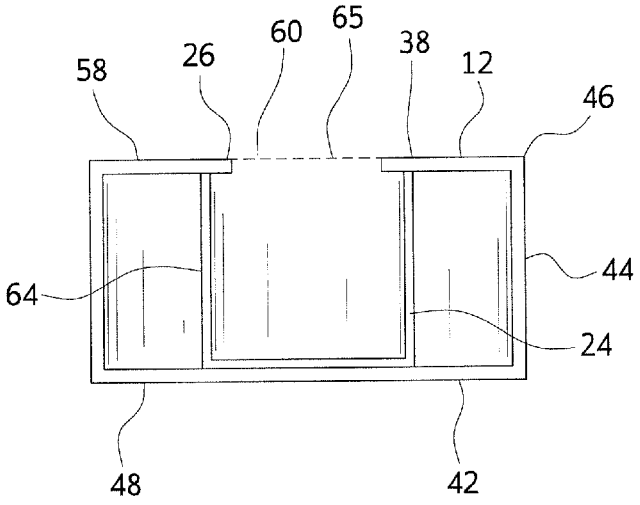
FIG. 9 is a cross sectional view along the line 9-9 in FIG. 1 (with the back cover member included).
Figure 10:
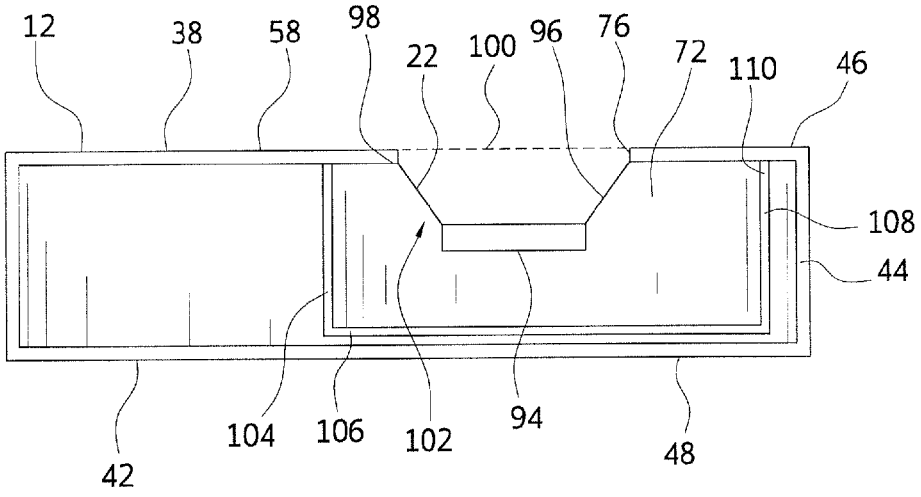
FIG. 10 is a cross sectional view along the line 10-10 in FIG. 1 (with the back cover member included).

The primary body member 46 includes a front side 52, which functions as the front surface 38 of the body 12 as discussed above, and a back side 50. Referring to FIGS. 1 and 7, which look at the back side 50 of the primary body member 46 of the electric guitar 10, the integrated speaker "cabinet" or speaker acoustic cabinet 72 with a "labyrinth" or "transmission line" resonant elongated acoustic chamber 24 extending therefrom is disclosed. The length and other dimensions of the labyrinth elongated acoustic chamber 24 are carefully calibrated and tuned to the onboard speaker 22, the speaker acoustic cabinet 72, the onboard, battery powered amplifier 20 and desired sound wave frequency range to allow a self-contained, amplified electric stringed musical instrument, for example, an electrical guitar, to achieve high quality full bodied sound not available in any other instruments currently available. The "transmission line" or "labyrinth" elongated acoustic chamber 24 allows balanced low frequency response to be achieved from a relatively small cabinet and speaker 22. "Transmission line" and "labyrinth" technology are used in certain "Hi-Fi" speaker cabinet designs but unknown in musical instruments.

More particularly, the primary body member 46 includes the front side 52 composed of a front wall 58 in which is formed an acoustic aperture 60 that ultimately defines the outlet port 26. A speaker aperture 76 is also formed in the front wall 58 of the primary body member 46. Positioned between the front side 52 of the primary body member 46 and the back side 50 of the primary body member 46 are the functional components of the acoustic system in accordance with the present invention.

The speaker 22 is secured to the speaker aperture 76. The speaker is a conventional speaker 22 with a magnet 94 and a cone 96 extending from the magnet 94. The speaker aperture 76 is aligned with the cone 96 of the speaker 22 and permits the direct passage of sound from the speaker 22. The top edge 98 of the speaker 22, that is, the mounting flange (not shown) at the top edge of the cone 96, is secured to the interior of the front wall 58 adjacent the speaker aperture 76. The speaker aperture 76 is covered with a grill 100. While a conventional speaker composed of a magnet and cone is disclosed in accordance with a preferred embodiment, the speaker may take a variety of forms so long as it constitutes an electro-acoustic transducer, driver or loudspeaker as those skilled in the art would understand.

About the backside 102 of the speaker 22, that is, in the area between the front side 52 of the primary body member 46 and the back side 50 of the primary body member 46, is formed the speaker acoustic cabinet 72. The speaker acoustic cabinet 72 contains the sound waves generated from the backward excursion of the cone 96 of the speaker 22 for transmission through the elongated acoustic chamber 24 when the instrument is played. The speaker acoustic cabinet 72 is defined by an enclosure 104 which fully surrounds the backside 102 of the speaker 22. For example, an in accordance with the embodiment disclosed herein the enclosure includes a closed bottom wall 106 with a side wall 108 extending therefrom. The free end 110 of the side wall 108 is secured the back side of the front wall 58 about the top edge 98 of the speaker 22, that is, the top edge of the cone 96, as it is secured to the interior of the front wall 58. The enclosure is provided with an aperture 82 to which the first end 62 of the elongated acoustic chamber 24 is coupled for the communication of sound waves from the speaker acoustic cabinet 72 to the elongated acoustic chamber 24.

The elongated acoustic chamber 24 extends in a serpentine manner within the space between the front side 52 of the primary body member 46 and the back side 50 of the primary body member 46. In accordance with the embodiment disclosed with reference to FIGS. 1 and 7, the elongated acoustic chamber 24 is a substantially closed elongated hollow body having an open first end 62 and an open second end 64. The open first end 62 of the elongated acoustic chamber 24 is in communication with the aperture of the speaker acoustic cabinet 72. The second end 64 of the elongated acoustic chamber 24 is connected to the acoustic aperture 60 in the front wall 58 of the primary body member 46 so as to define the output port 26. In this way, sound generated by the speaker 22 is guided along the elongated acoustic chamber 24 for transmission out the acoustic aperture 60, which in accordance with a preferred embodiment is covered with a grill 65. While a grill is disclosed in accordance with a preferred embodiment, it is appreciated the acoustic aperture may be left uncovered. It is also appreciated the acoustic aperture may be formed along the back surface or side walls of the body.

It is also appreciated the guitar may be provided with other structural components offering useful features. For example, the guitar may be provided with an onboard rechargeable battery integrated with the powered amplifier. On the other hand, it is appreciated it the guitar may be provided with plug for connection with a standard AC outlet or other outboard power supply. The guitar may also be provided with proprietary "tone shaping" electronics and/or functional ergonomic placement of controls and certain cosmetic features.

As briefly discussed above, it is appreciated the elongated acoustic chamber 24 may be constructed in various ways. For example, the embodiment disclosed in FIGS. 1 and 7 provides an elongated acoustic chamber 24 that is formed with the front wall 58 of the primary body member 46. In accordance with an alternate embodiment as disclose with reference to FIG. 3, the elongated acoustic chamber 24 is composed of round plastic tubing 70 extending between the acoustic aperture 60 formed in the front wall 58 of the primary body member 46 and the speaker acoustic cabinet 72.

Figure 2:
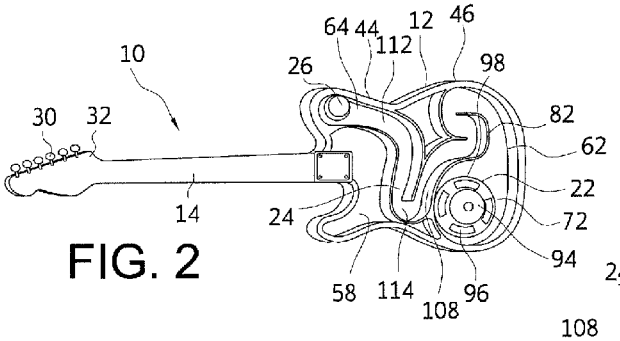
FIG. 2 is a back side view, with the back cover member thereof removed, of an electric guitar in accordance with an alternate embodiment of the present invention.
Figure 3:
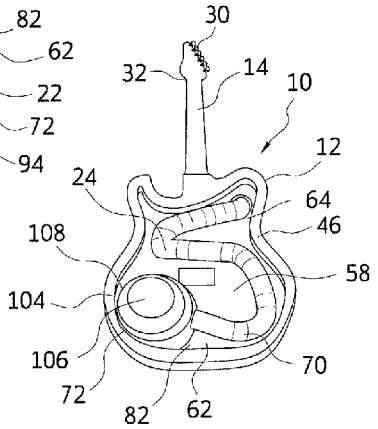
FIG. 3 is a back side view, with the back cover member thereof removed, of an electric guitar in accordance with yet another embodiment of the present invention.
Figure 4:
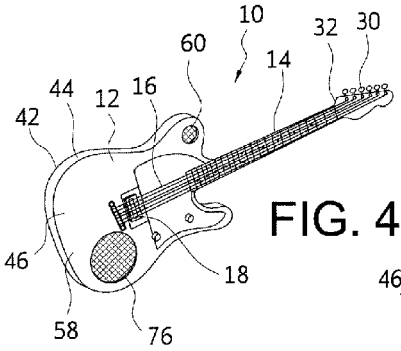
FIG. 4 is a front perspective view of an electric guitar in accordance with the present invention.
Figure 5:
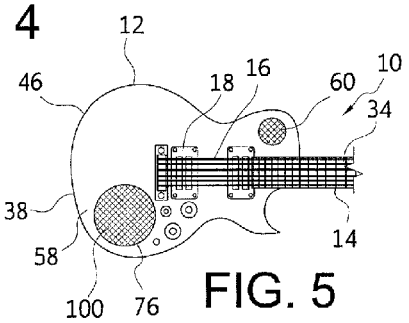
FIGS. 5 and 6 are front plan views of an electric guitar in accordance with the present invention.
Figure 6:
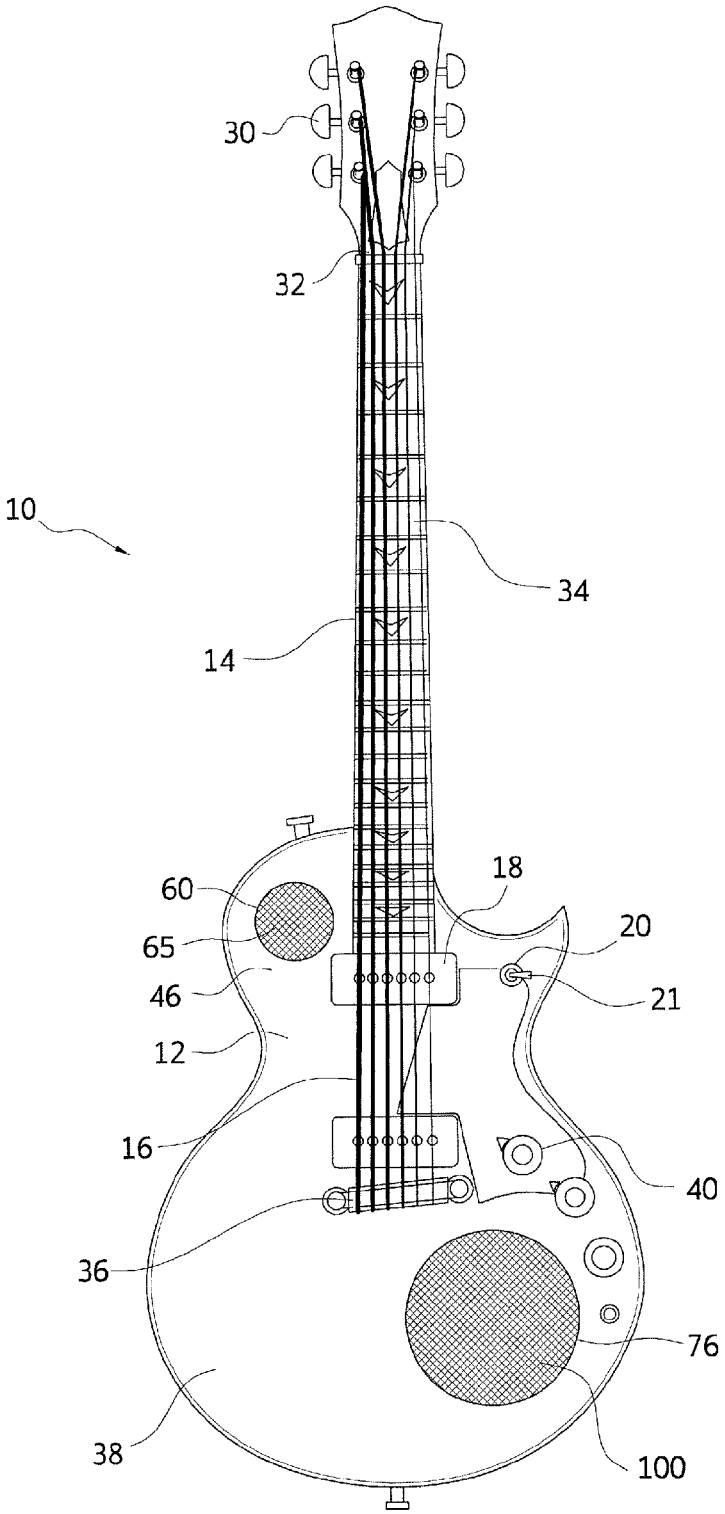

In accordance yet another embodiment, and with reference to FIG. 2, the elongated acoustic chamber 24 may be defined by an elongated recess 112 having opposed walls 114 formed within the primary body member 46 which is cover by the back cover member 48 to close off the elongated recess 112 for the transmission of sound therein in accordance with the present invention. That is, the elongated acoustic chamber 24 is composed of walls defined by the front wall 58, the opposed walls 114, and the back cover member 48.

It is appreciated the length of line making up the elongated acoustic chamber is calibrated for in-phase low frequency reinforcement at the exit port or output port 26 on the front surface 38 of the instrument (guitar) 12. Although various embodiments are disclosed for the creation of an elongated acoustic chamber in accordance with the present invention, it is appreciated other structures for creating a tuned acoustic transmission line are contemplated. Other ways include but are not limited to: routing of a sound pathway in solid wood body; a labyrinth created from plastic insert(s); other shapes of tube such as square, triangular, etc. The elongated acoustic chamber can be routed along any number of alternate pathways to accommodate placement of pick-up(s), controls, battery compartment, onboard circuits, etc.

It is also appreciated the elongated acoustic chamber may be provided with "stuffing." That is, the labyrinthine elongated acoustic chamber may be partially filled with Dacron pillow filler or similar "stuffing". The stuffing may also be applied in the speaker acoustic cabinet. This serves the purpose of partially absorbing the high frequency back waves, instead of allowing them to reflect off the closed bottom wall of the speaker acoustic cabinet and back through the front speaker aperture. Reflected sound waves are out of phase and cause unwanted sound wave cancellations.

It is further appreciated various acoustic dampening materials in various forms may be used to control feedback. For example, mass loaded vinyl or similar materials are strategically placed as a loudspeaker gasket 118 along the edge of the elongated acoustic chamber 24. This is similar to rubber motor mounts in a car, which prevent engine vibrations from being transmitted to the passenger compartment. Other uses for this material in the guitar include around bridge mounting bolts, pickup mounts, neck joint, etc. as needed to decouple the strings/pickups from the speaker and vibrating body "cabinet".

It is further appreciated the wiring associated with the various components are well known to those skilled in the art of electric stringed musical instruments and has been excluded from the drawings to enhance clarity by focusing upon the functional components of the present invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. An electric stringed musical instrument, comprising:

a body including a front side and a back side;

a neck extending from the body;

a plurality of tensioned strings extending between the body and the neck;

an electric pick-up mounted to the body at a location for cooperation with the tensioned strings;

an amplifier electrically connected to the electric pick-up;

a speaker connected to the amplifier for the generation of sound waves, the speaker being mounted to the body with a cone of the speaker in alignment with a speaker aperture formed in the front side of the body;

a speaker acoustic cabinet surrounding a backside of the speaker such that sound waves generated from backward excursion of the cone of the speaker are contained therein; and an acoustic transmission line defined by an elongated acoustic chamber extending from the speaker acoustic cabinet to an output port;

wherein the amplifier, speaker and elongated acoustic chamber are housed within the body.

2. The electric stringed musical instrument according to claim 1, wherein the amplifier includes a battery.

3. The electric stringed musical instrument according to claim 1, wherein the acoustic transmission line is serpentine.

4. The electric stringed musical instrument according to claim 1, wherein the electric stringed musical instrument is a guitar.

5. The electric stringed musical instrument according to claim 1, further including acoustic damping material to control feedback.

6. An electric stringed musical instrument, comprising:

a body including a front side and a back side;

a neck extending from the body;

a plurality of tensioned strings extending between the body and the neck;

an electric pick-up mounted to the body at a location for cooperation with the tensioned strings;

an amplifier electrically connected to the electric pick-up;

a speaker connected to the amplifier for the generation of sound waves, the speaker being mounted to the body with a cone of the speaker in alignment with a speaker aperture formed in the front side of the body; and an acoustic transmission line defined by an elongated acoustic chamber extending from the speaker to an output port formed in the front side of the body.

7. The electric stringed musical instrument according to claim 6, wherein the amplifier includes a battery.

8. The electric stringed musical instrument according to claim 7, wherein the battery is a rechargeable battery.

* * * * *